US007677926B1

(12) United States Patent
Huang

(10) Patent No.: US 7,677,926 B1
(45) Date of Patent: Mar. 16, 2010

(54) CONNECTOR JACK AND CONNECTOR COMBINATION USING SAME

(75) Inventor: Mao-Sheng Huang, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/414,684

(22) Filed: Mar. 31, 2009

(30) Foreign Application Priority Data

Oct. 21, 2008 (CN) ..... 2008 1 0305071

(51) Int. Cl.
*H01R 13/648* (2006.01)

(52) U.S. Cl. ..... 439/607.38

(58) Field of Classification Search ..... 439/607.38, 439/607.34, 607.35, 607.36, 607.37, 607.39, 439/607.4, 607.2, 607.21, 607.27
See application file for complete search history.

(56) References Cited

U.S. PATENT DOCUMENTS 4,878,858 A * 11/1989 Dechelette ..... 439/607.38
5,525,078 A * 6/1996 Springer ..... 439/607.38
5,685,739 A * 11/1997 Davis et al. ..... 439/607.38
5,879,173 A * 3/1999 Poplawski et al. ..... 439/138
6,190,205 B1 * 2/2001 Wu ..... 439/607.34
6,267,606 B1 * 7/2001 Poplawski et al. ..... 439/92
6,302,737 B1 * 10/2001 Billman ..... 439/607.23
6,319,062 B1 * 11/2001 Ma et al. ..... 439/607.38
6,364,700 B1 * 4/2002 Zhu et al. ..... 439/567
6,375,505 B1 * 4/2002 Lin ..... 439/607.37
6,416,358 B1 * 7/2002 Kamarauskas et al. . 439/607.38
6,416,359 B1 * 7/2002 Zhang et al. ..... 439/607.37
6,500,028 B1 * 12/2002 Higuchi ..... 439/607.37
6,503,102 B1 * 1/2003 Zhang et al. ..... 439/607.55
6,530,809 B2 * 3/2003 Handa et al. ..... 439/607.38
6,629,857 B1 * 10/2003 Ma et al. ..... 439/567
6,641,425 B1 * 11/2003 Wu ..... 439/352
6,755,689 B2 * 6/2004 Zhang et al. ..... 439/607.01
6,827,610 B2 * 12/2004 Lin ..... 439/607.37
7,008,266 B2 * 3/2006 Fang ..... 439/607.35
7,052,321 B2 * 5/2006 Chang ..... 439/607.37
7,086,902 B1 * 8/2006 Yang ..... 439/607.36
7,097,504 B2 * 8/2006 Kan ..... 439/607.35
7,097,507 B1 * 8/2006 Zhang et al. ..... 439/607.35
7,128,607 B2 * 10/2006 Li ..... 439/607.36
7,300,215 B2 * 11/2007 Hsiao et al. ..... 385/92
7,371,012 B2 * 5/2008 Schunk ..... 385/88
7,380,995 B2 * 6/2008 Chan ..... 385/92
7,481,667 B2 * 1/2009 Cheng ..... 439/490
2002/0009905 A1 * 1/2002 Poplawski et al. ..... 439/76.1
2002/0142634 A1 * 10/2002 Poplawski et al. ..... 439/98
2004/0127102 A1 * 7/2004 Poplawski et al. ..... 439/630

* cited by examiner

*Primary Examiner*—T C Patel
*Assistant Examiner*—Vladimir Imas
(74) *Attorney, Agent, or Firm*—Frank R. Niranjan

(57) ABSTRACT

A connector jack includes a housing, a receptacle shield, and a brace. The housing is configured for receiving a plug. The receptacle shield defines a receiving space for receiving the housing and exposing a plug receiving chamber of the housing to the outside, and includes two inward projecting prongs. Each prong has a base portion and a free end bent to form a ramped surface projecting inward into the interior of the receptacle. The brace is positioned between the receptacle shield and the housing, and has a main frame and two tabs respectively connected on the two ends of the main frame for abutting the prongs of the receptacle shield.

20 Claims, 5 Drawing Sheets

CONNECTOR JACK AND CONNECTOR COMBINATION USING SAME

BACKGROUND

1. Technical Field

The present invention relates generally to connectors, particularly to a connector jack with electromagnetic interference protection and a connector combination using the same.

2. Description of Related Art

Connectors are widely used in computers for transferring or receiving data externally. To protect the integrity of the data, the electrical connectors should be protected from electromagnetic interference (EMI). Generally, a connector jack of a connector has a metal casing covering an insulating housing to block electromagnetic waves. The metal casing of the connector jack has an integral contact tongue capable of grounding a connector plug. However, the contact tongue is prone to being damaged after repeatedly usage (plugging and unplugging). As a result, a damaged contact tongue provides poor grounding contact between the metal casing and the connector plug, and the electromagnetic waves of the connector may not be blocked.

Therefore, it is desirable to provide a connector jack to overcome the above mentioned problems.

DETAILED DESCRIPTION

Figure 1:
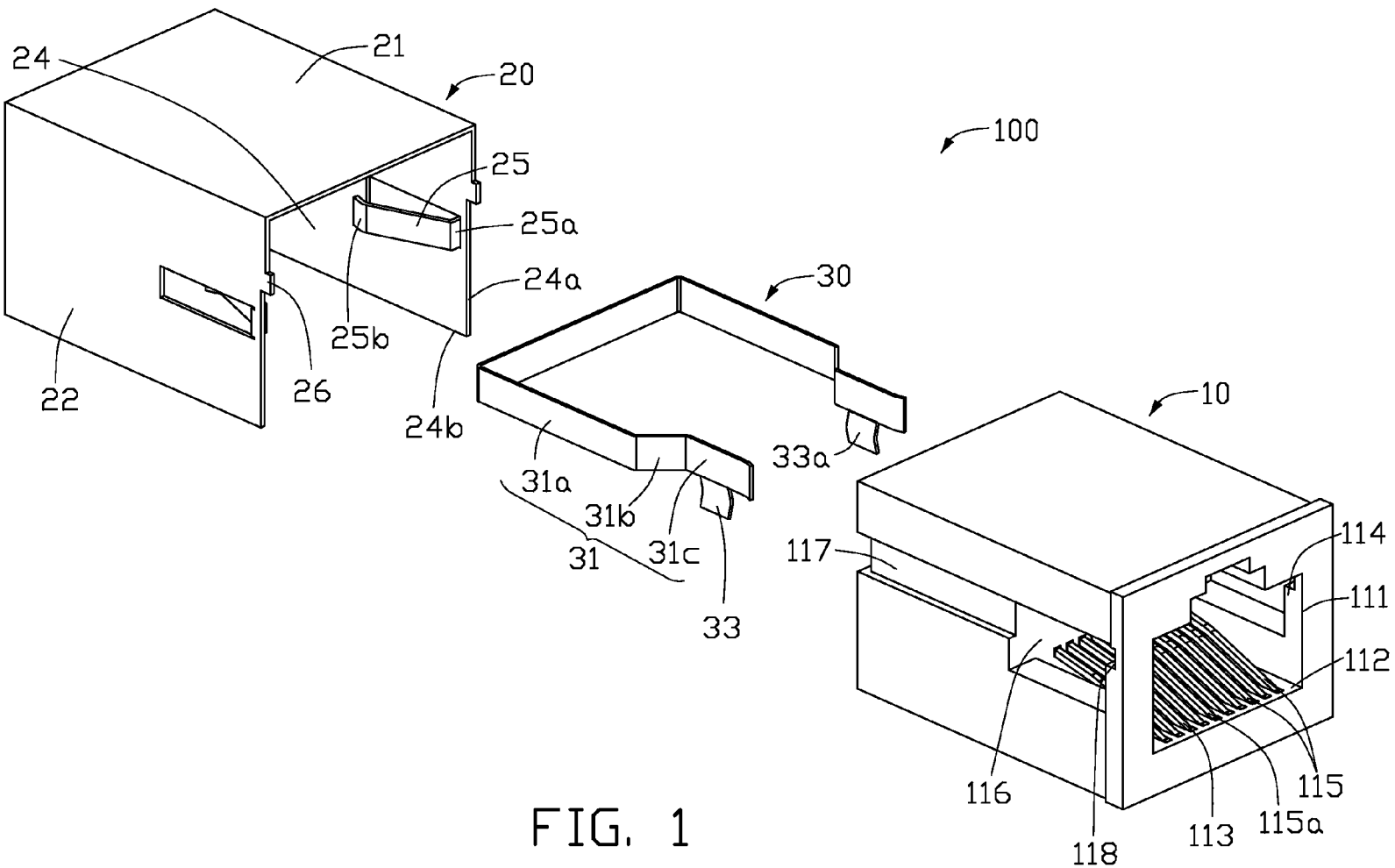
FIG. 1 is an isometric, exploded view of a connector jack according to an exemplary embodiment.
Figure 2:
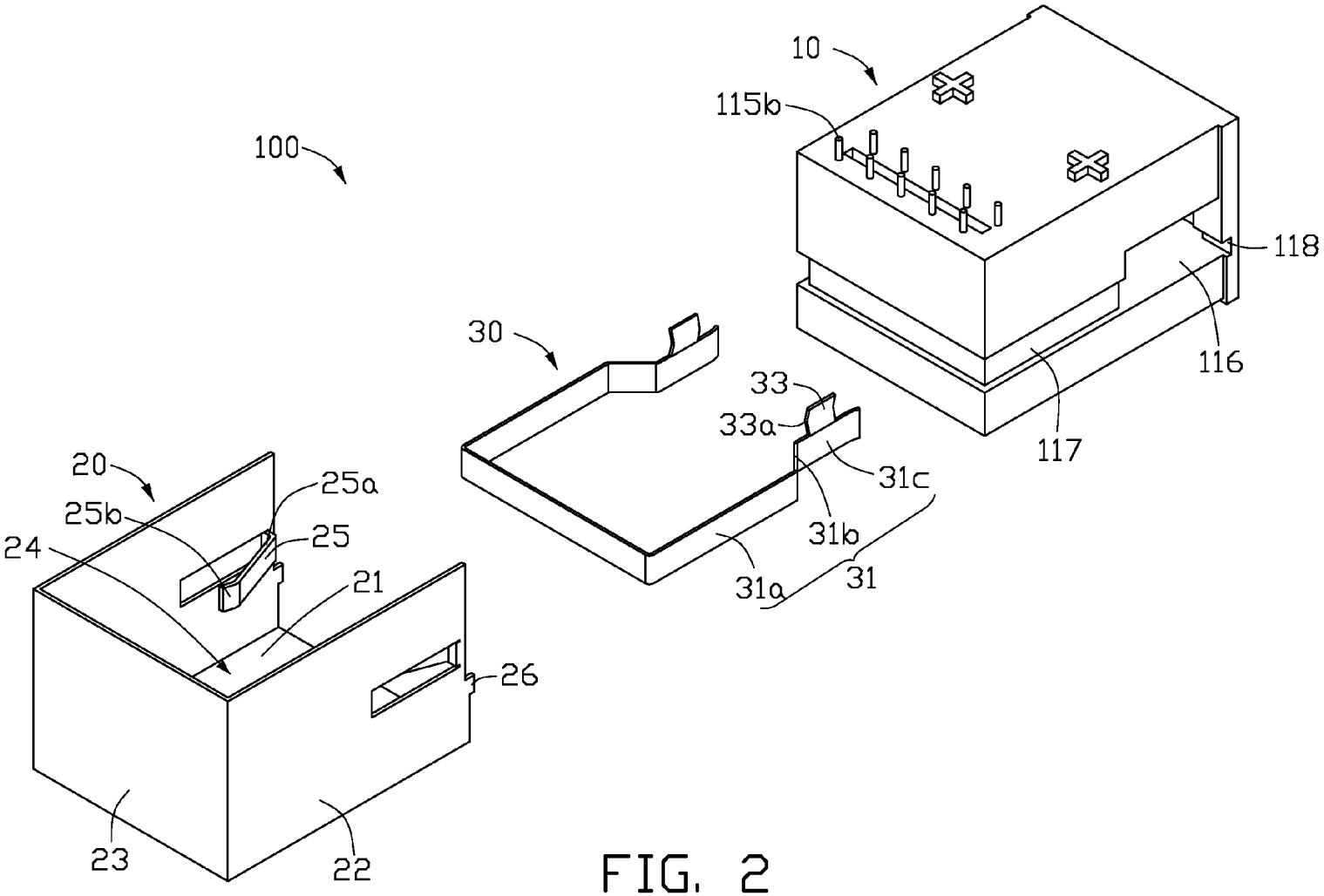
FIG. 2 is an isometric, exploded view of the connector jack of FIG. 1 viewed from another perspective.

Referring to FIGS. 1-2, a connector jack 100 in accordance to one embodiment of the present invention is disclosed. The connector jack 100 includes an insulated housing 10, a receptacle shield 20, and a brace 30. The receptacle shield 20 is configured for covering the housing 10 and capable of grounding with a male connector when the male connector is plugged in the housing 10. The brace 30 is positioned between the receptacle shield 20 and the housing 10 for enhancing the electromagnetic interference (EMI) protection of the connector jack 100.

The housing 10 defines a plug receiving chamber 111 that is configured for receiving the meal connector (not shown). On a bottom 112 of the plug receiving chamber 111, a number of slots 113 are defined for receiving a number of contact fingers 115 correspondingly. Each of the contact fingers 115 includes a first contact region 115*a*, a second contact region 115*b*, and a middle portion (not shown) connecting the regions 115*a*, 115*b*. The first regions 115*a* of the contact fingers 115 are mounted in the slots 113. The middle portions of the contact fingers 115 are embedded in the housing 10. The second contact regions 115*b* of the contact fingers 115 protrudes out of the housing 10 to electrically connect to a circuit board (not shown). Two through holes 116 are symmetrically defined in side-walls 114 on opposite sides of the plug receiving chamber 111, adjacent to the bottom 112. A groove 117 is defined on the housing 10, surrounding the outer side surface of the housing 10, and forming a connective space together with the through holes 116. Two recessed notches 118 are separately defined on the inner walls of the through holes 116 in alignment with the groove 117.

The receptacle shield 20 includes a top wall 21, two support walls 22 on opposite sides of the receptacle shield 20, and a back wall 23 collectively defining a receiving space 24 for receiving the housing 10. The support walls 22 extend substantially perpendicular from opposite ends of the top wall 21. The back wall 23 connects with the top wall 21 and the support walls 22. The receiving space 24 defines two adjacent openings 24*a*, 24*b*. The openings 24*a*, 24*b* are configured to snap onto the housing 10, exposing the plug receiving chamber 111 from the opening 24*a*. The receptacle shield 20 includes two prongs 25 located near the opening 24*a* and projecting inwards. Each prong 25 includes a base portion 25*a* punched out of the support walls 22, and a free end 25*b* bent to form a ramped surface projecting inward into the interior of the receiving space 24. The bent free ends 25*b* of the prongs 25 are configured for accommodating in the through holes 116 of the housing 10 correspondingly, thereby grounding the male connector when it is plugged in the housing 10. A projection 26 protrudes from each edge of the support walls 22, adjacent to the opening 24*a* of the receiving space 24 to precisely and firmly fit the housing 10 in the receptacle shield 20. The receptacle shield 20 is made of metal and mechanically grounded on the circuit board by a number of metal connecting arms (not shown).

The brace 30 includes a main frame 31 configured to be snapped in the groove 117 and the through holes 116 of the housing 10. The brace 30 also includes two tabs 33 extending from ends of the main frame 31. The main frame 31 is substantially U-shaped having two arms 31*a* extending parallel and symmetric to each other. An end of each arm 31*a* is bent inwards forming an inclined portion 31*b* and a clip end 31*c*. Each clip end 31C is substantially parallel to the arm 31*a*, and the inclined portion 31*b* is connected between the arm 31*a* and the clip end 31*c* correspondingly. Two tabs 33 are respectively formed on the corresponding clip ends 31*c*. Each tab 33 is arched inward to form a contact point 33*a* for abutting the prongs 25 thereby grounding the receptacle shield 20 and the male connector plugged in the plug receiving chamber 111 of the housing 10 securely. Understandably, the thickness of the arms 31*a* is slightly thicker than the depth of the groove 117 of the housing 10, therefore the receptacle shield 20 can firmly wrap/clip to the housing 10 via the arms 31*a* of the brace 30. The brace 30 is made of elastic material and preferable elastic metal material.

Figure 3:
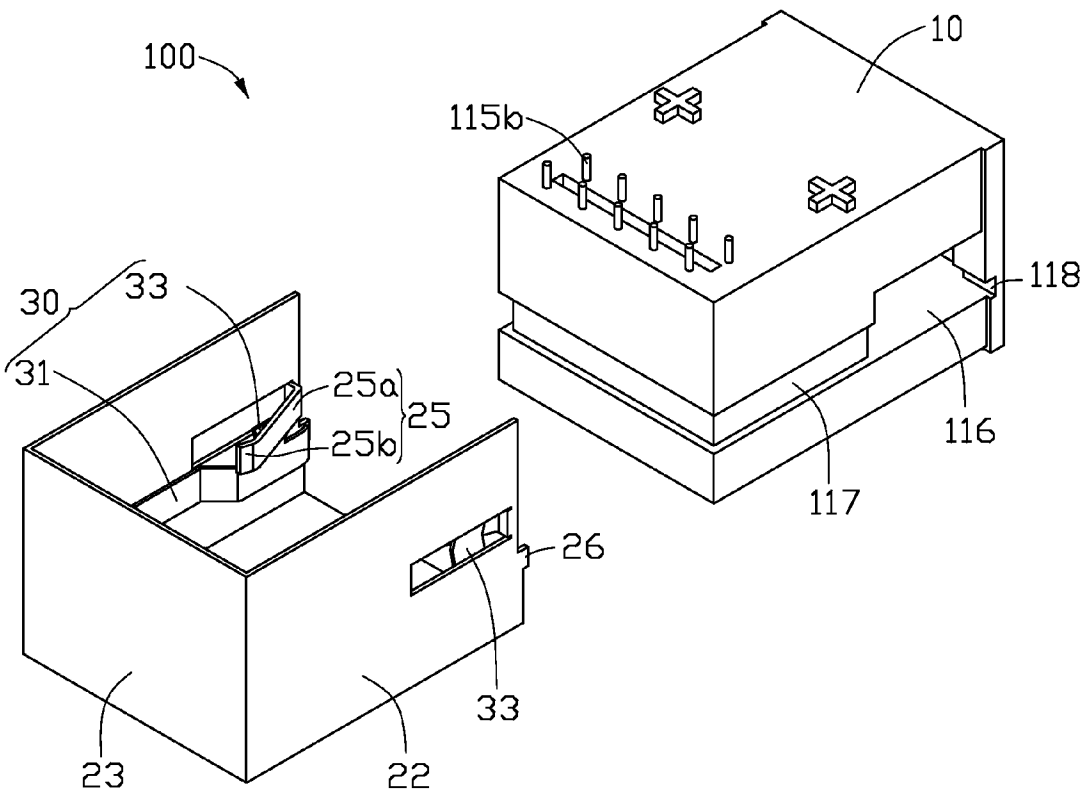
FIG. 3 is an isometric, partially assembled view of the connector jack of FIG. 1.
Figure 4:
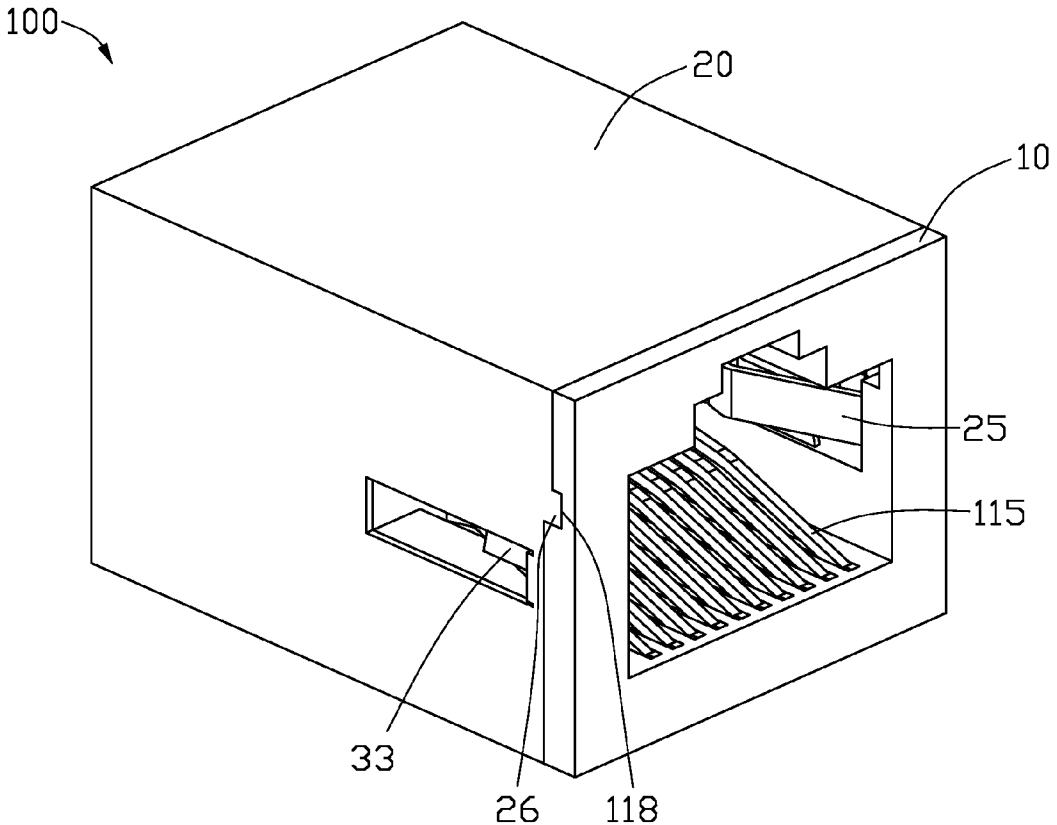
FIG. 4 is an isometric, assembled view of the connector jack of FIG. 1.

In assembly, referring to the FIGS. 3-4, the brace 30 is positioned on the inner surfaces of the back wall 23 and the support walls 22 of the receptacle shield 20, and the tabs 33 of the brace 30 are inserted and caught between the prongs 25 and the support walls 22 correspondingly. The receptacle shield 20 fixed with the brace 30 is sleeved on the outer side of the housing 10 with the projection 26 inserted into the recessed notches 118 of the housing 10. The arms 31*a* are disposed in the groove 117. The prongs 25 of the receptacle shield 20, the inclined portions 31*b*, the clip ends 31*c*, and the tabs 33 of the brace 30 are all disposed in the through holes 116 of the housing 10.

Figure 5:
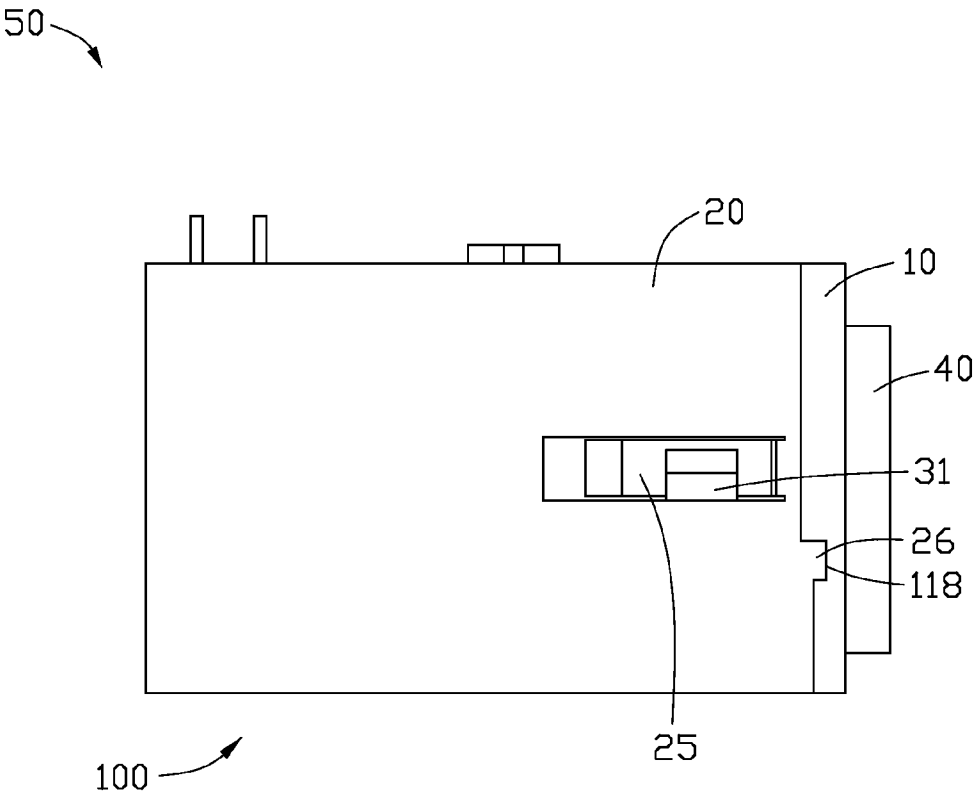
FIG. 5 is a lateral plane, assembled view of the connector combination of the connector jack of FIG. 1 and a connector plug.

Referring to FIG. 5, in use, a connector plug 40 is plugged in the plug receiving chamber 111 (see FIG. 1) of the housing 10, thereby coupling the plug 40 with the connector jack 100 to form a connector combination 50. In the connector combination 50 of the connector jack 100 and plug 40, the plug 40 is shaped according to the shape of the plug receiving chamber 111 of the connector jack 100 and formed with a number of conductive terminals (not shown) corresponding to the contact fingers 115. When the plug 40 is plugged into the plug receiving chamber 111 of the housing 10, the conductive terminals are electrically coupled to the contact fingers 115 correspondingly, and the prongs 25 of the connector jack 100 abut on opposite side surfaces of the connector plug 40 grounding the connector plug 40, thereby protecting the connector plug 40 from electromagnetic interference. Furthermore, if the prongs 25 of the receptacle shield 20 are inadvertently broken, the tabs 33 of the brace 30 would still abut the prongs 25 that are damaged, thus, can keep the prongs 25 being grounded to the connector plug 40. As a result, the connector combination 50 of the connector jack 100 and the connector plug 40 has a stable and reliable electromagnetic waves protection.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A connector jack comprising:

a housing configured for receiving a plug therein;

a receptacle shield defining a receiving space for receiving the housing and exposing portion of the housing to outside, the receptacle shield further comprising two inward projecting contact prongs, each prong comprising a base portion, a free end bent to form a ramped surface projecting inward into the interior of the receiving space; and a brace positioned between the receptacle shield and the housing, the brace comprising a main frame and two tabs respectively connected to the two ends of the main frame, the tabs abutting the prongs of the receptacle shield for enhancing electromagnetic interference protection of the connector jack.

2. The connector jack as claimed in claim 1, wherein the housing defines a plug receiving chamber therein which is exposed from the receptacle shield.

3. The connector jack as claimed in claim 2, wherein the housing defines a plurality of slots on a bottom of the plug receiving chamber, and a plurality of contact fingers are mounted in the corresponding slots.

4. The connector jack as claimed in claim 3, wherein two through holes are symmetrically defined in side-walls on opposite sides of the plug receiving chamber, and a groove is defined on the housing, surrounding outer side surface of the housing and forming a connective space together with the through holes; the brace is snapped in the groove and the through holes.

5. The connector jack as claimed in claim 4, wherein the receptacle shield comprises a top wall, two support walls, and a back wall which all are collectively defined the receiving space therein and two adjacent openings communicated with the receiving space.

6. The connector jack as claimed in claim 5, wherein the prongs are respectively formed on the support walls adjacent to the opening projecting inwards.

7. The connector jack as claimed in claim 5, wherein two recessed notches are defined on each of the inner wall of the through holes and in alignment with the groove; corresponding to the recessed notches, the receptacle shield has two projections respectively protruding outward from the front edges of the support walls thereof, and the two projections are inserted in the recessed notches.

8. The connector jack as claimed in claim 4, wherein the main frame of the brace is received in the groove and the through holes of the housing.

9. The connector jack as claimed in claim 8, wherein the main frame comprises two arms extending symmetrically and parallelly, and the thickness of the arms is slightly thicker than that of the depth of the groove of the housing.

10. The connector jack as claimed in claim 8, wherein the main frame of the brace comprises two arms extending symmetrically and parallelly to each other, and an end of each arm is bent inwards forming an inclined portion and a clip end.

11. The connector jack as claimed in claim 10, wherein the tabs are respectively formed on the corresponding clip ends of the main frame and inserted and caught between the support walls and the prongs of the receptacle shield.

12. The connector jack as claimed in claim 11, wherein each tab is arched inward to form a contact point for abutting the prongs.

13. The connector jack as claimed in claim 1, wherein the brace is made of elastic material.

14. The connector jack as claimed in claim 1, wherein the brace is made of elastic metal material.

15. The connector jack as claimed in claim 1, wherein the receptacle shield is made of metal material.

16. A connector jack comprising:

a housing;

a receptacle shield comprising two prongs sleeved the housing, the two prongs extending into the housing for grounding a connector plug to be plugged in the housing; and a brace positioned between the receptacle shield and the housing to abut the prongs for enhancing the electromagnetic interference protection of the connector jack.

17. The connector jack as claimed in claim 16, wherein the brace comprises a main frame, and two tabs respectively connected to the two ends of the main frame, and the tabs are respectively abutting the prongs.

18. A connector combination comprising:

a connector jack comprising:

a housing;

a receptacle shield comprising two prongs sleeved the housing, the two prongs extending into the housing for grounding a connector plug to be plugged in the housing; and a brace positioned between the receptacle shield and the housing to abut the prongs; and a connector plug plugged into the housing and grounded by the receptacle shield.

19. The connector combination as claimed in the claim 18, wherein the two prongs project inwards with respect to the receptacle shield.

20. The connector combination as claimed in claim 18, wherein the brace comprises a main frame, and two tabs respectively connecting the two ends of the main frame, the tabs respectively abutting the corresponding prongs.

* * * * *